US008146778B2

(12) United States Patent
Shen

(10) Patent No.: US 8,146,778 B2
(45) Date of Patent: Apr. 3, 2012

(54) BALL FEEDING DEVICE

(75) Inventor: Chiung-Hung Shen, Tainan (TW)

(73) Assignee: Sheng-Hsiao Lu, Anding Township, Tainan County (TW)

( * ) Notice: Subject to any disclaimer, the term of this patent is extended or adjusted under 35 U.S.C. 154(b) by 277 days.

(21) Appl. No.: 12/692,681

(22) Filed: Jan. 25, 2010

(65) Prior Publication Data

US 2011/0180561 A1 Jul. 28, 2011

(51) Int. Cl.
*B65G 59/06* (2006.01)

(52) U.S. Cl. ..... 221/113; 221/120; 221/132; 221/289; 221/114; 221/119

(58) Field of Classification Search ..... 221/113, 221/120, 119, 114, 116, 104, 132, 124
See application file for complete search history.

(56) References Cited

U.S. PATENT DOCUMENTS 4,094,294 A * 6/1978 Speer ..... 124/56
4,207,857 A * 6/1980 Balka, Jr. ..... 124/56
5,044,350 A * 9/1991 Iwabuchi et al. ..... 124/51.1
5,836,477 A * 11/1998 Yeh ..... 221/135
6,237,583 B1 * 5/2001 Ripley et al. ..... 124/78

* cited by examiner

*Primary Examiner* — Michael K Collins
(74) *Attorney, Agent, or Firm* — Alan Kamrath; Kamrath IP Lawfirm, PA

(57) ABSTRACT

A ball feeding device includes a mounting seat with a driving device. The driving device includes a driving shaft defining an axis of rotation. A discharge hole is provided in a top plate of the mounting seat. An annular guiding wall is formed on the top plate and surrounds the axis of rotation. A rotary unit is rotatably mounted on the top plate and includes tubes for containing balls. A blocking member is mounted in each tube. When the rotary unit is rotated, lower ends of the tubes are aligned with the discharge hole in sequence such that the balls in the tubes are fed into a pitching machine one by one. The blocking members hold or release the balls in the tubes under the action of the guiding wall such that the balls to be fed cannot contact with the top plate.

5 Claims, 10 Drawing Sheets

BALL FEEDING DEVICE

FIELD OF THE INVENTION

The present invention relates to a ball feeding device and, more particularly, to a ball feeding device that feeds baseballs or softballs into a pitching machine one by one.

BACKGROUND OF THE INVENTION

Referring to FIGS. 9 to 10, a conventional ball feeding device is shown and includes a mounting seat 10. A driving device 101 is mounted in mounting seat 10 and includes a driving shaft 102 having an upper end protruded out of a top plate 103 of the mounting seat 10. A rotary unit is connected to driving shaft 102 to rotate therewith and includes a plurality of lower tubes 20 arranged in a circle. Each lower tube 20 includes a lower slot 202 and a through-hole 201 for receiving a ball 60. An upper tube 30 is coupled to an upper end of each lower tube 20 and includes an upper slot 302 and a through-hole 301 for receiving another ball 60. The lower and upper slots 202 and 302 of each lower tube 20 and an associated upper tube 30 are communicated with each other and form a cruciform slot. A sleeve 50 is coupled to an upper end of each upper tube 30 for containing a supply of balls 60. The top plate 103 of the mounting seat 10 is provided with a discharge hole 104 and a riser 105. A baffle plate 40 is engaged to an upper end of the riser 105 and extended into one of the cruciform slots. By rotating the driving device 101, the rotary unit is rotated so that the ball 60 in the lower tube 20 in alignment with the discharge hole 104 falls down into a pitching machine (not shown) via the discharge hole 104, with the ball 60 in the upper tube 30 in alignment with the discharge hole 104 being stopped by the baffle plate 40 and, thus, prevented from dropping into the discharge hole 104. Hence, the balls 60 in the lower tubes 20 can be fed into the pitching machine one by one during rotation of the driving shaft 102.

However, the conventional ball feeding device is operated in such a manner that the balls 60 in the lower tubes 20 are in contact with the top plate 103 of the mounting seat 10, causing friction between the balls 60 and top plate 103 of the mounting seat 10 and damage to the balls 60 and the driving device 101. To avoid excessive frictional resistance between the balls 60 and top plate 103 of the mounting seat 10, some restrictions are placed on the weight and quality of the balls 60 so that the conventional ball feeding device cannot be widely applied to different kinds of balls and pitching machines.

The present invention is therefore intended to obviate or at least alleviate the problems encountered in the prior art.

BRIEF SUMMARY OF THE INVENTION

It is the primary objective of the present invention to provide a ball feeding device that features simple construction and allows different kinds of baseballs or softball to be fed into various pitching machines.

To achieve the foregoing objective, the ball feeding device includes a mounting seat adapted to be connected to a pitching machine and including a top plate. A driving device is mounted in the mounting seat and includes a driving shaft extending in a vertical direction and defining an axis of rotation. The mounting seat further includes a discharge hole extending from an upper face of the top plate through the top plate in the vertical direction and spaced from the driving shaft in a radial direction perpendicular the vertical direction. The mounting seat further includes a guiding wall formed on the upper face of the top plate and surrounding the axis of rotation. The guiding wall includes an arcuate segment with an opening facing the discharge hole. The guiding wall further includes a recessed segment located within the arcuate segment and facing the opening of the arcuate segment. The recessed segment includes a first end connected to the arcuate segment and a second end. A spacing from the second end of the recessed segment to the axis of rotation in the radial direction is smaller than that from the arcuate segment to the axis of rotation in the radial direction. The guiding wall further includes a guiding segment located within the arcuate segment and connected between the second end of the recessed segment and the arcuate segment. The ball feeding device further includes a rotary unit rotatably mounted on the top plate of the mounting seat. The rotary unit includes an engaging portion engaged to the driving shaft of the driving device to rotate therewith. The rotary unit further includes a plurality of tubes arranged around the engaging portion of the rotary unit and surrounding the axis of rotation. Each tube receives at least one ball and includes lower and upper end spaced in the vertical direction. The ball feeding device further includes a plurality of blocking members each pivotably connected to an interior wall of an associated tube. Each blocking members is pivotable relative to the rotary unit between a first position holding the ball in the associate tube and a second position releasing the ball in the associate tube. Each blocking members includes a lower arm abutting on the guiding wall of the mounting seat. The lower arm of each blocking member abuts against the arcuate segment of the guiding wall when the blocking member is in the first position, and the lower arm of each blocking member abuts against the recessed segment of the guiding wall when the blocking member is in the second position. When the rotary unit is rotated, the lower ends of the tubes align with the discharge hole of the mounting seat in sequence so that the balls held by the blocking members fall into the pitching machine one by one from the discharge hole of the mounting seat.

In the most preferred form, each blocking member further includes an upper arm and a pivotal portion located between the lower and upper arms and pivotably connected to the interior wall of the associated tube. Each tube further includes a notch facing the engaging portion. The pivotal portion of each blocking member is located above the notch of the associated tube. The lower arm of each blocking member abuts against the guiding wall of the mounting seat through the notch. The lower arm of each blocking member abuts against the recessed segment of the guiding wall so that the balls held by the blocking members fall down from the discharge hole when the lower arm of the blocking member moves to the opening of the arcuate segment of the guiding wall.

The present invention will become clearer in light of the following detailed description of illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
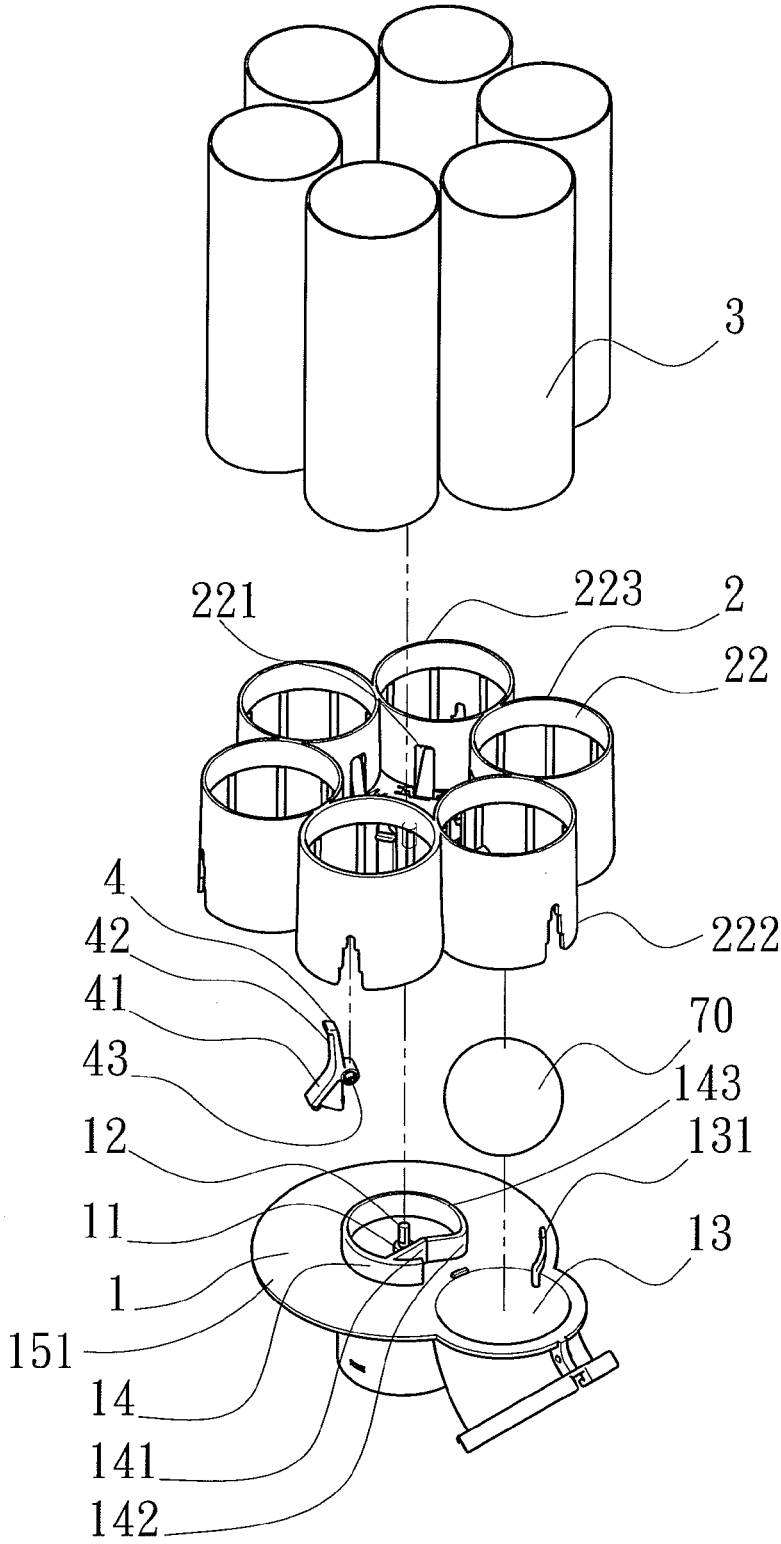
FIG. 1 shows an exploded, perspective view of a ball feeding device according to the present invention.
Figure 2:
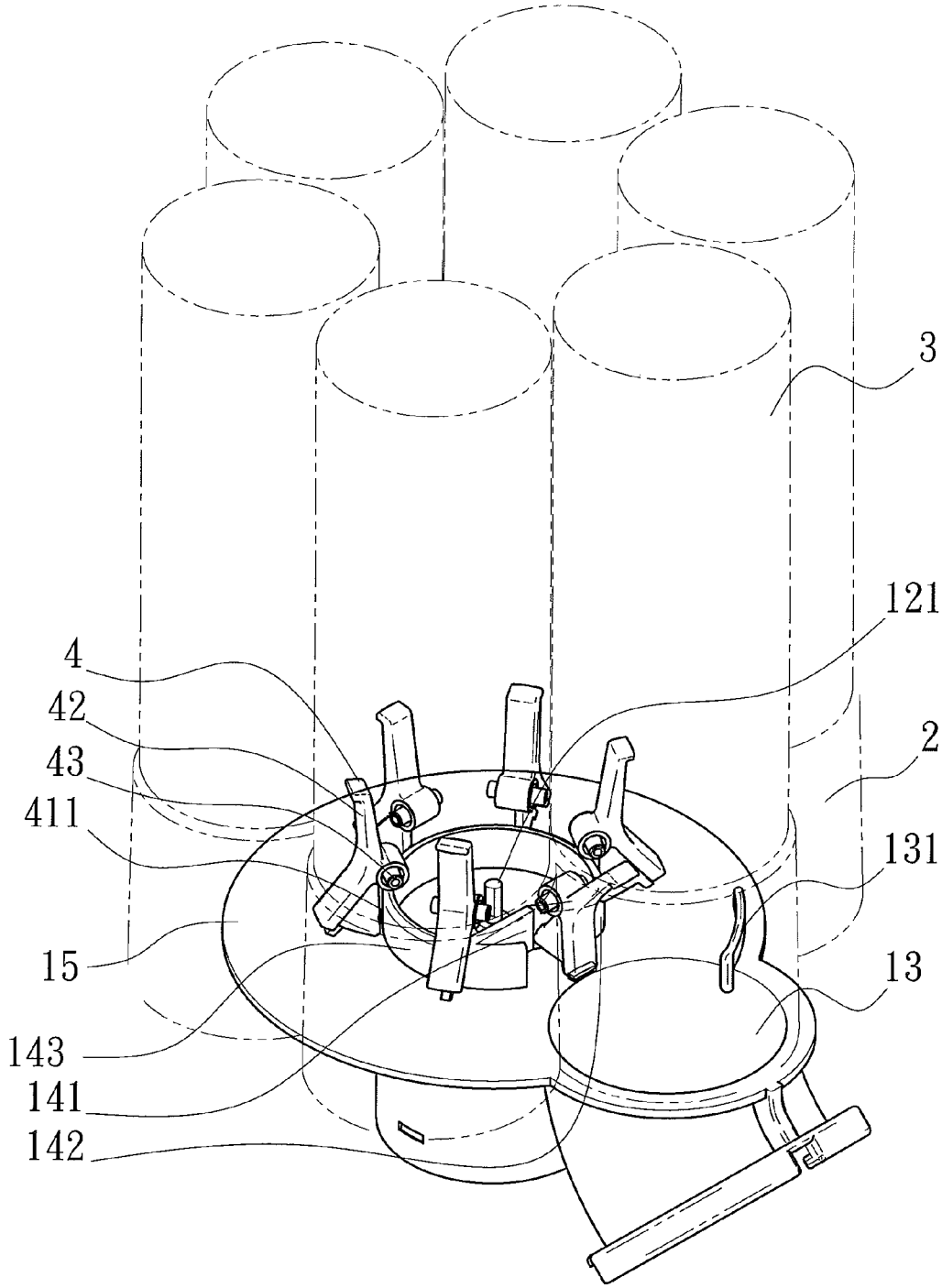
FIG. 2 shows a schematic perspective view of the ball feeding device of FIG. 1.
Figure 3:
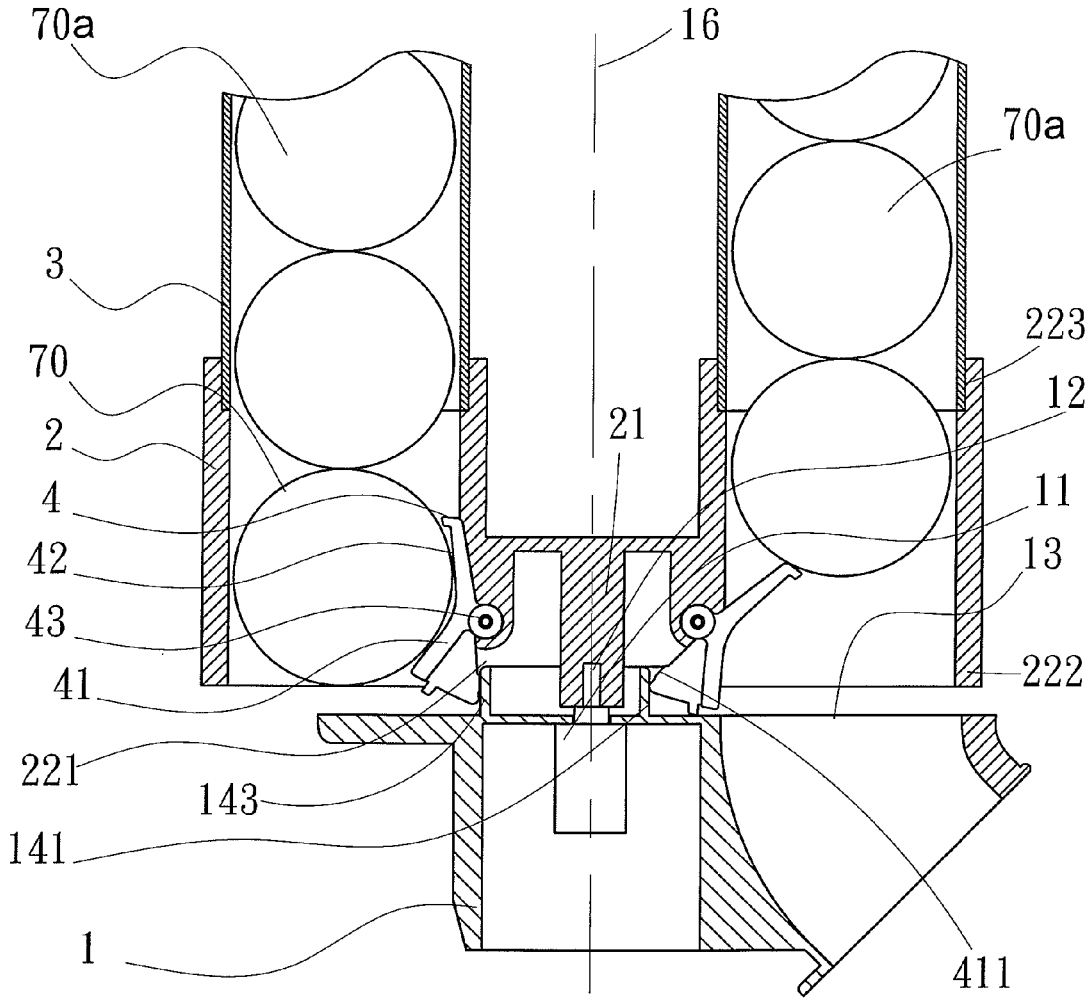
FIG. 3 shows a partial cross sectional view of the ball feeding device of FIG. 1.
Figure 4:
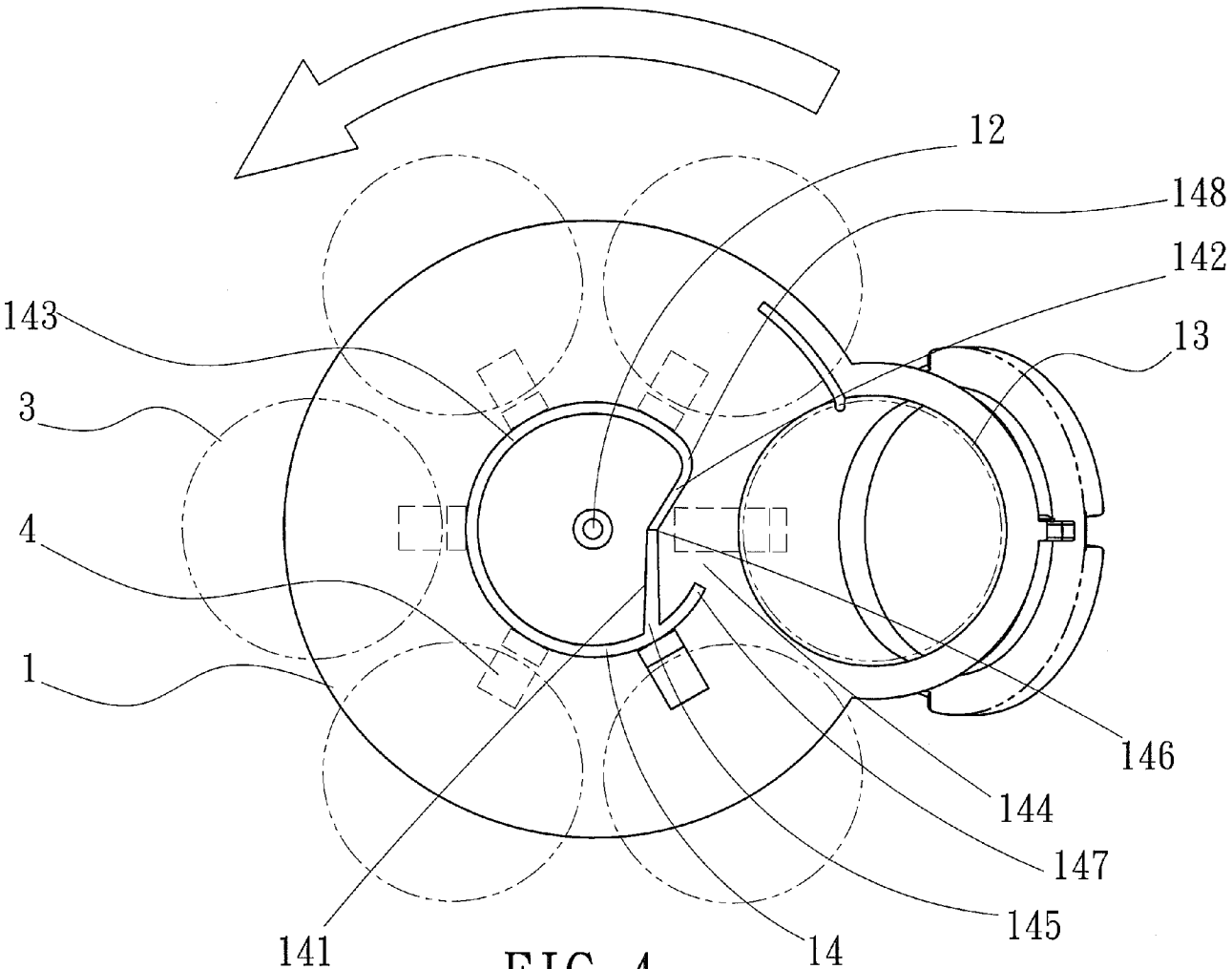
FIG. 4 shows a top view of the ball feeding device of FIG. 2.
Figure 5:
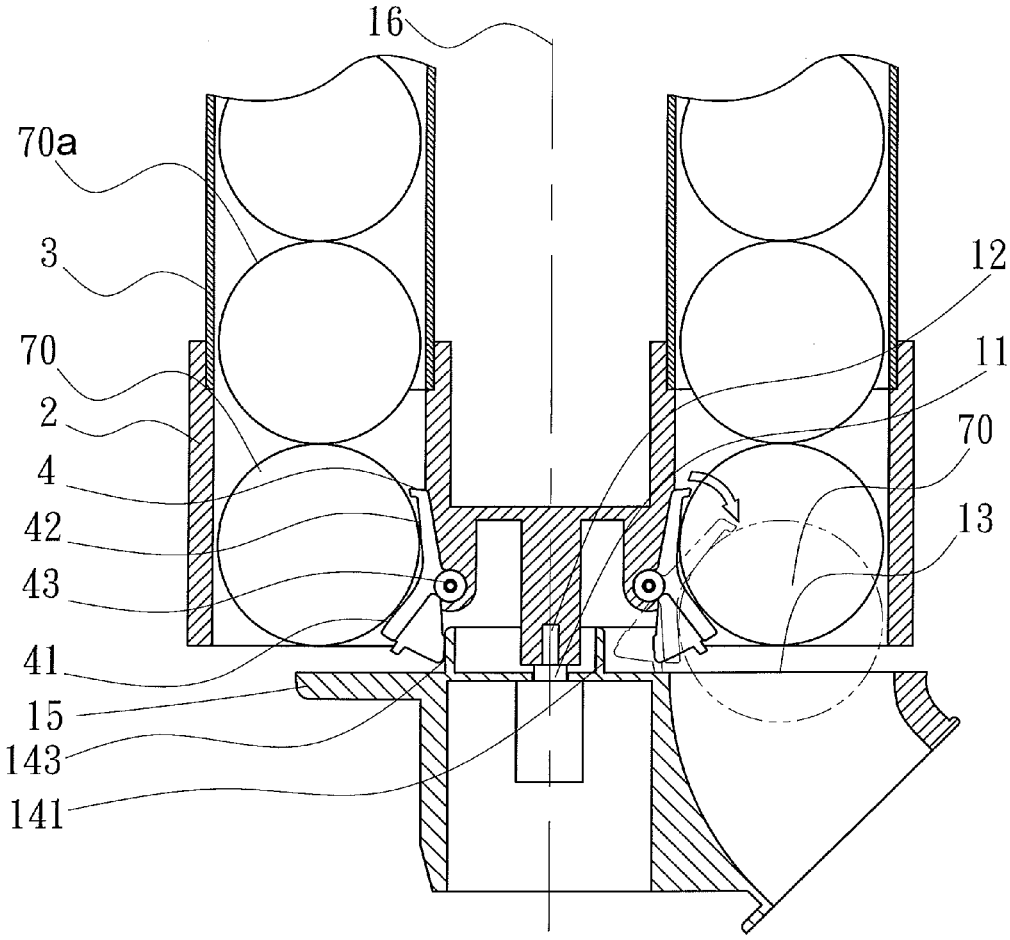
FIG. 5 shows a cross sectional view similar to FIG. 3, wherein a blocking member is rotated in a counterclockwise direction.
Figure 6:
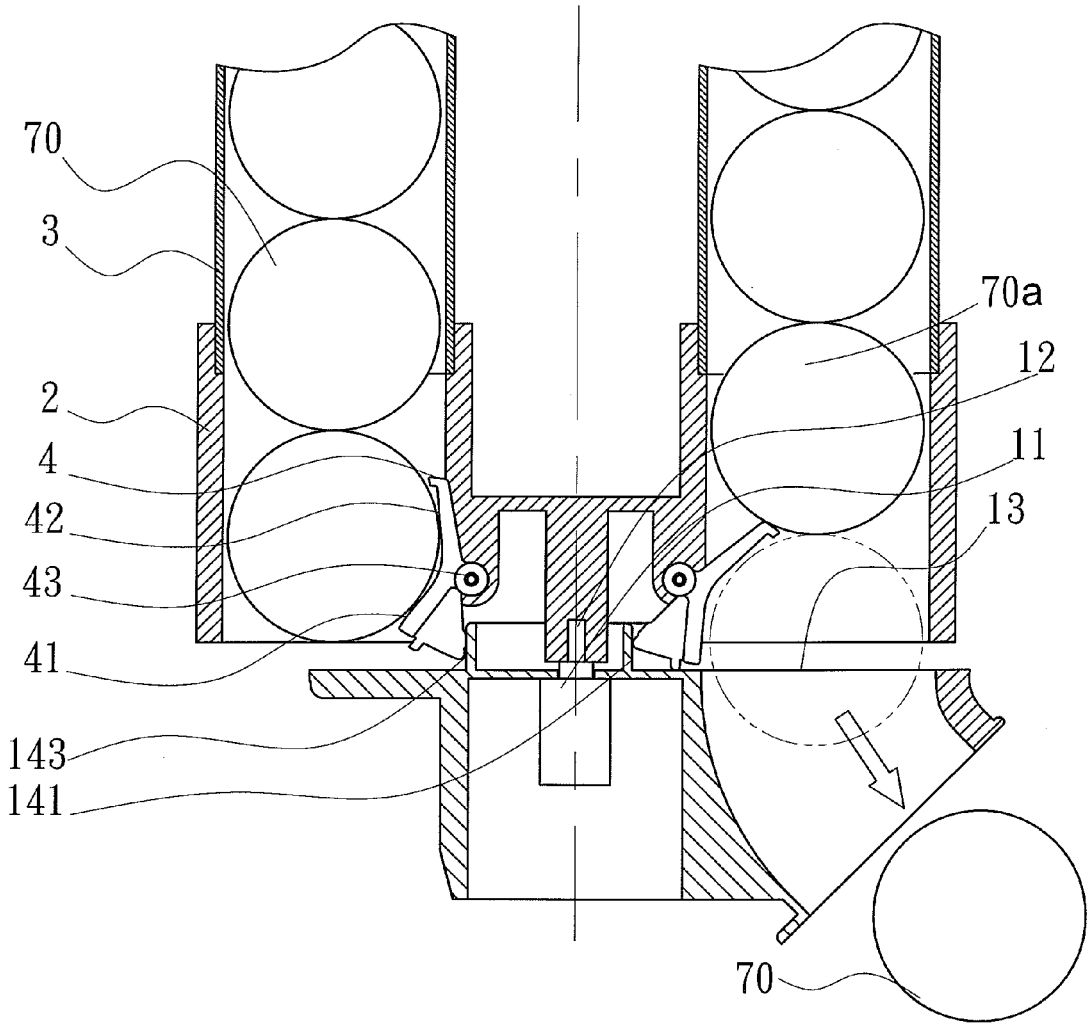
FIG. 6 shows a cross sectional view similar to FIG. 5, wherein a ball drops down from a discharge hole.
Figure 7:
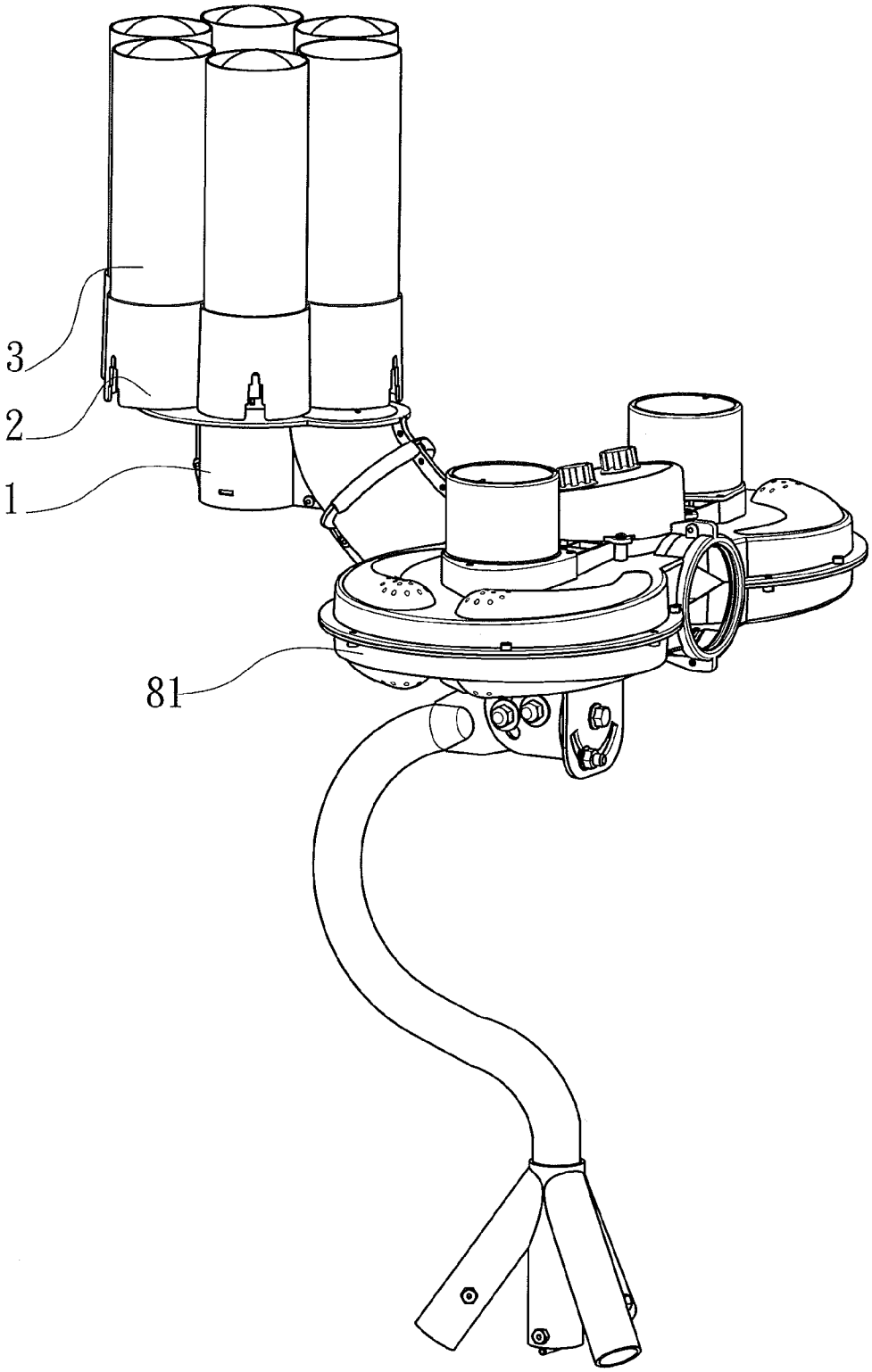
FIG. 7 shows a diagrammatic perspective view of the ball feeding device of FIG. 1 and a pitching machine to which the ball feeding device is coupled.
Figure 8:
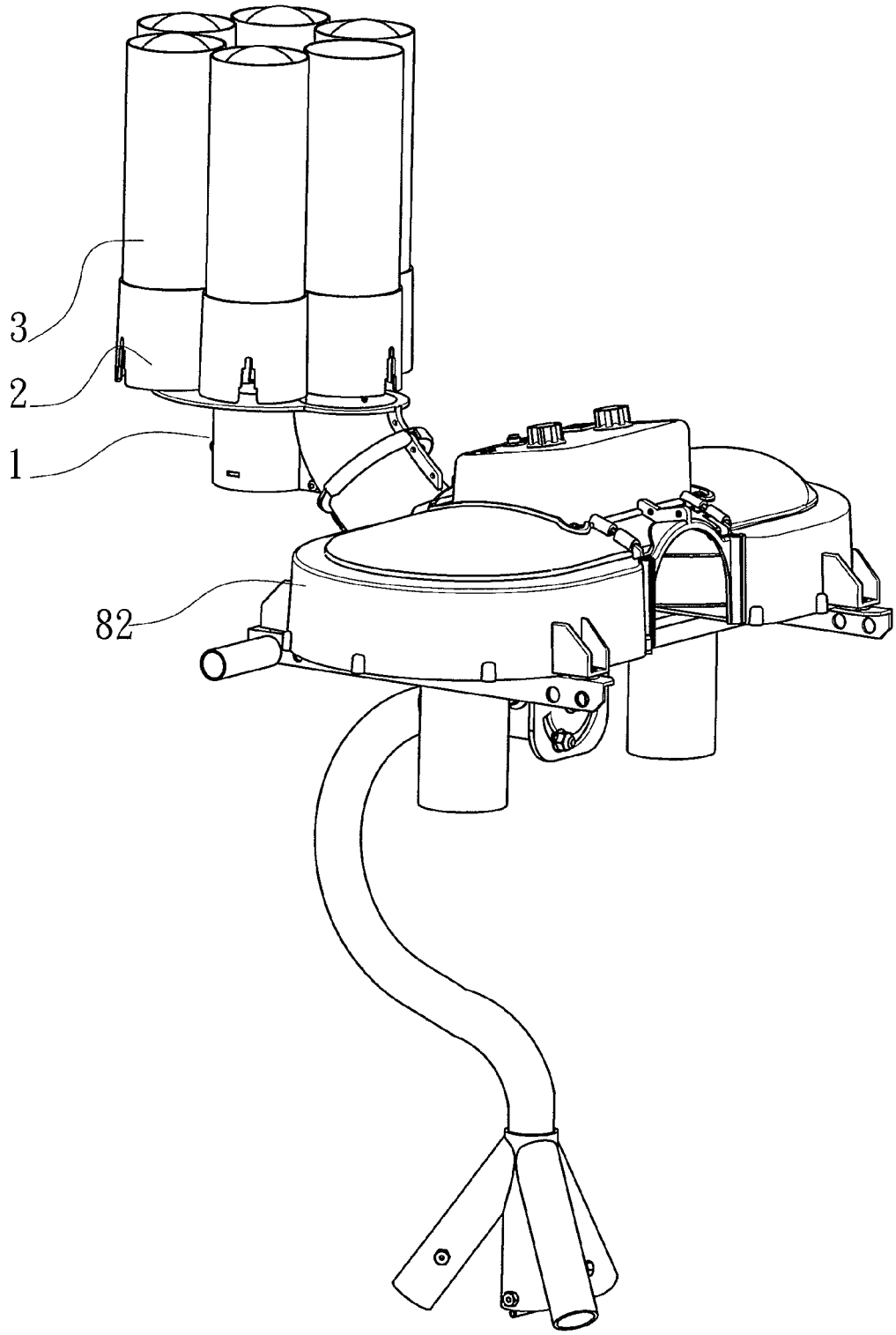
FIG. 8 shows a diagrammatic perspective view of the ball feeding device of FIG. 1 and another pitching machine to which the ball feeding device is coupled.
Figure 9:
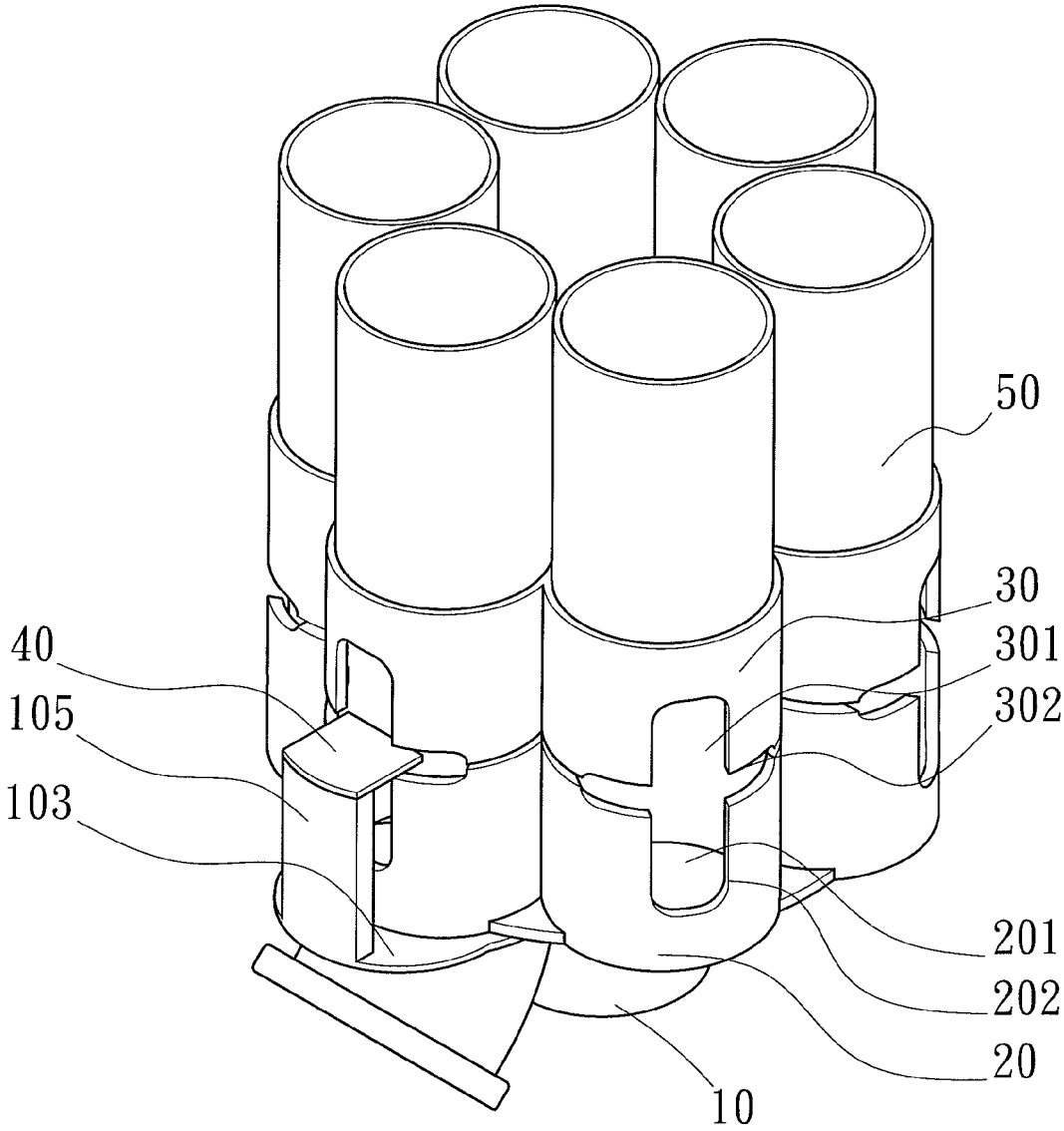
PRIOR ART FIG. 9
FIG. 9 shows a perspective view of a conventional ball feeding device.
Figure 10:
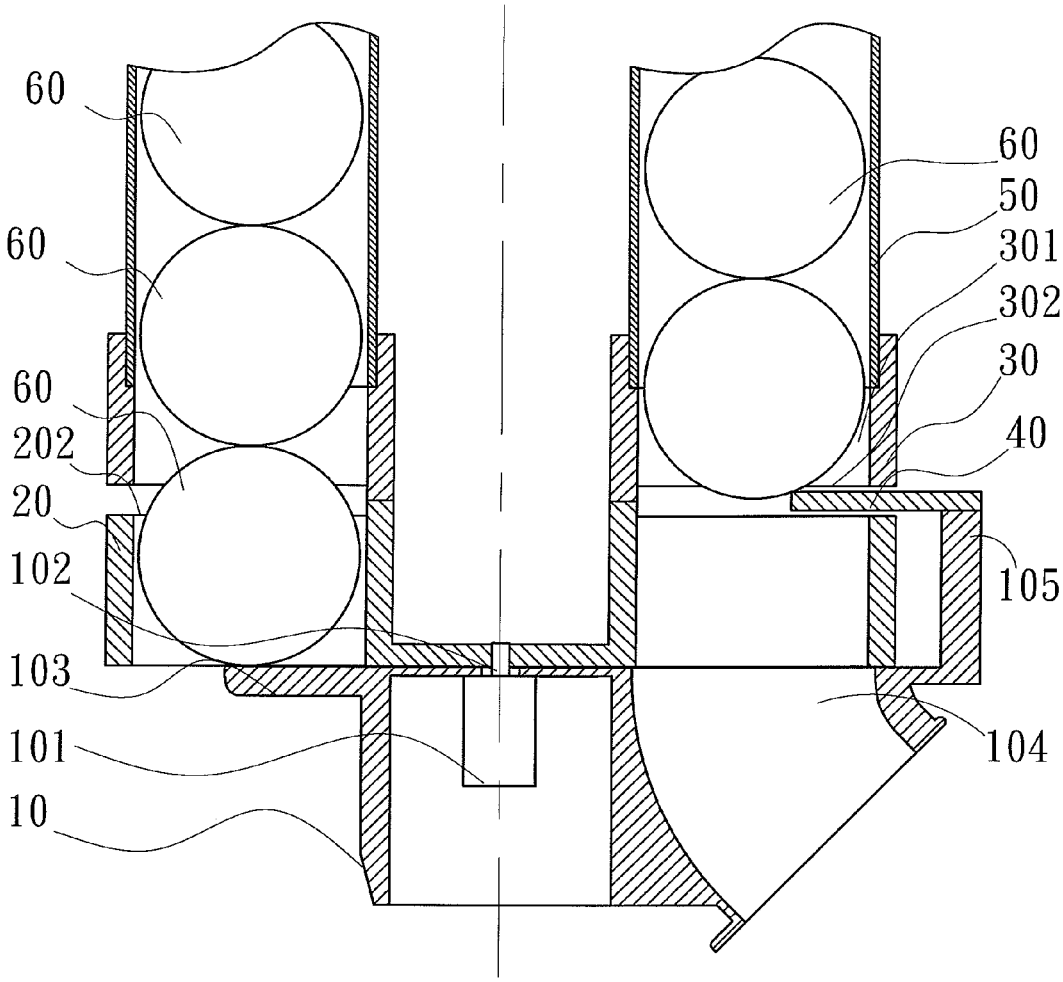
PRIOR ART FIG. 10
FIG. 10 shows a cross sectional view of the ball feeding device of FIG. 9.

Referring to FIGS. 1 through 6, a ball feeding device includes a mounting seat 1, a rotary unit 2 and a plurality of blocking members 4 according to the preferred embodiment of the present invention. The mounting seat 1 is connected to a pitching machine 81 or 82 (see FIGS. 7 and 8). The mounting seat 1 includes a top plate 15 and a discharge hole 13 extending from an upper face 151 of the top plate 15 through the top plate 15 in a vertical direction. A driving device 11 is mounted in the mounting seat 1 and includes a driving shaft 12 extending in the vertical direction and defining an axis of rotation 16. According to the preferred form shown, the driving shaft 12 has an upper end 121 extending beyond the upper face 151 of the top plate 15. The discharge hole 13 is spaced from the driving shaft 12 in a radial direction perpendicular the vertical direction. A guiding portion 131 is formed on the upper face 151 of the top plate 15 and adjacent to the discharge hole 13. The mounting seat 1 further includes a guiding wall 14 formed on the upper face 151 of the top plate 15 and surrounding the axis of rotation 16. The guiding wall 14 includes an arcuate segment 143 taking the axis of rotation 16 as its center. The arcuate segment 143 includes first and second ends 147 and 148 spaced in a circumferential direction thereof and defining an opening 144 facing the discharge hole 13 (see FIG. 4). The guiding wall 14 further includes a recessed segment 141 located within the arcuate segment 143 and facing the discharge hole 13. The recessed segment 141 includes a first end 145 connected to the arcuate segment 143 and a second end 146. A spacing from the second end 146 of the recessed segment 141 to the axis of rotation 16 in the radial direction is smaller than that from the arcuate segment 143 to the axis of rotation 16 in the radial direction. The guiding wall 14 further includes a guiding segment 142 connected between the second end 146 of the recessed segment 141 and the second end 148 of the arcuate segment 143. According to the preferred form shown, the guiding segment 142 of the guiding wall 14 is at an obtuse angle with the recessed segment 141 of the guiding wall 14.

The rotary unit 2 is rotatably mounted on the top plate 15 of the mounting seat 1 and includes an engaging portion 21 located at a center thereof and engaged to the driving shaft 12 of the driving device 1. The rotary unit 2 further includes a plurality of tubes 22 arranged around the engaging portion 21 and surrounding the axis of rotation 16. Each tube 22 includes lower and upper ends 222 and 223 spaced in the vertical direction. At least one ball 70 is received in each tube 22. A sleeve 3 is engaged on the upper end 223 of each tube 22 for containing a supply of balls 70*a*. The lower end 222 of each tube 22 is provided with a notch 221 facing the engaging portion 21. When the driving device 1 is activated, the rotary unit 2 is rotated so that the lower ends 222 of the tubes 22 align with the discharge hole 13 in sequence.

Each blocking member 4 is pivotably mounted in one of the tubes 22 of the rotary unit 2 and includes a lower arm 41, an upper arm 42, and a pivotal portion 43 located between the lower and upper arms 41 and 42. Pivotal portion 43 of each blocking member 4 is located above the notch 221 of an associated tube 22 and pivotably connected to an interior wall (not labeled) of the associated tube 22 such that each blocking member 4 is pivotable relative to the associated tube 22 between a first position and a second position. The upper arm 42 of each blocking member 4 is intermediate the lower arm 41 of the blocking member 4 and the upper end 223 of the associated tube 22. According to the preferred form shown, the lower and upper arms 41 and 42 of each blocking member 4 are formed into a claw-shaped in cross section and capable of holding the ball 70 in the associated tube 22. The lower arm 41 of each blocking member 4 includes an inner side 411 abutting against the guiding wall 14 of the mounting seat 1 through the notch 221 of associated tube 22. The lower arm 41 of each blocking member 4 abuts against the arcuate segment 143 of the guiding wall 14 when the blocking member 4 is in the first position. The lower arm 41 of each blocking member 4 abuts against the recessed segment 141 of the guiding wall 14 when the blocking member 4 is in the second position.

In operation, balls 70, 70*a* are filled in the tubes 22 of the rotary unit 2 and sleeves 3 with balls 70 in the tubes 22 being respectively held by the lower and upper arms 41 and 42 of the blocking member 4 without contact with the top plate 15. By rotating the driving device 11, the rotary unit 2 is rotated (arrow in FIG. 4 indicates the direction of rotation of the rotary unit 2), and the lower arm 41 of each blocking member 4 is moved along and abuts against the guiding wall 14 of the mounting seat 1. When the lower end 222 of one of the tubes 22 comes into alignment with the discharge hole 13 of the mounting seat 1 (see FIGS. 5 and 6), the lower arm 41 of the blocking member 4 in the tube 22 is moved to the opening 144 of the arcuate segment 143 of the guiding wall 14 and abuts against the recessed segment 141 of the guiding wall 14 so that the ball 70 held by the blocking member 4 falls down and is discharged from the discharge hole 13. At the same time, the upper arm 42 of the blocking member 4 is rotated in a clockwise direction to stop the balls 70*a* over the discharged ball 70 from falling down. Next, the lower arm 41 of the blocking member 4 moves along the guiding segment 142 to the arcuate segment 143 of the guiding wall 14 so that the blocking member 4 is rotated in a counterclockwise direction to hold the ball 70 in the tube 22. Furthermore, the blocking members 4 in other tubes 22 of the rotary unit 2 will be moved to the opening 144 of the arcuate segment 143 in sequence during the rotation of the rotary unit 2. Thus, the balls 70 in the tubes 22 of the rotary unit 2 will be discharged one by one from the discharge hole 13 of the mounting seat 1 and then fed into the pitching machines 81, 82 shown in FIGS. 7 and 8.

When the rotary unit 2 is rotated, the blocking members 4 in the tubes 22 are rotated between the first position (holding the balls 70) and the second position (releasing the balls 70) under the action of the guiding wall 14 so as to ensure that the balls 70 to be discharged cannot come into contact the top plate 15 of the mounting seat 1, eliminating friction resistance between the balls 70 and the top plate 15. Thus, the ball feeding device of the present invention is adapted for transporting and feeding balls with different quality into various kinds of pitching machines 81, 82.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A ball feeding device comprising, in combination:

a mounting seat adapted to be connected to a pitching machine and including a top plate, with a driving device mounted in the mounting seat and including a driving shaft extending in a vertical direction and defining an axis of rotation, with the mounting seat further including a discharge hole extending from an upper face of the top plate through the top plate in the vertical direction, with the discharge hole spaced from the driving shaft in a radial direction perpendicular the vertical direction, with the mounting seat further including a guiding wall formed on the upper face of the top plate and surrounding the axis of rotation, with the guiding wall including an arcuate segment with an opening facing the discharge hole, with the guiding wall further including a recessed segment located in the arcuate segment and facing the discharge hole, with the recessed segment including a first end connected to the arcuate segment and a second end, with a spacing from the second end of the recessed segment to the axis of rotation in the radial direction being smaller than that from the arcuate segment to the axis of rotation in the radial direction, with the guiding wall further including a guiding segment connected between the second end of the recessed segment and the arcuate segment;

a rotary unit rotatably mounted on the top plate of the mounting seat, with the rotary unit including an engaging portion engaged to the driving shaft of the driving device to rotate therewith, with the rotary unit further including a plurality of tubes arranged around the engaging portion of the rotary unit and surrounding the axis of rotation, with each of the plurality of tubes receiving at least a ball, with each of the plurality of tubes including lower and upper ends spaced in the vertical direction; and a plurality of blocking members each pivotably connected to an interior wall of an associated tube, with each of the plurality of blocking members being pivotable relative to the rotary unit between a first position holding the ball in the associate tube and a second position releasing the ball in the associate tube, with each of the plurality of blocking members including a lower arm abutting on the guiding wall of the mounting seat, with the lower arm of each of the plurality of blocking members abutting against the arcuate segment of the guiding wall when the blocking member is in the first position, with the lower arm of each of the plurality of blocking members abutting against the recessed segment of the guiding wall when the blocking member is in the second position;

wherein when the rotary unit is rotated, the lower ends of the plurality of tubes align with the discharge hole of the mounting seat in sequence so that the balls held by the blocking members fall into the pitching machine one by one from the discharge hole of the mounting seat.

2. The ball feeding device according to claim 1, with each of the plurality of blocking members further including an upper arm and a pivotal portion located between the lower and upper arms and pivotably connected to the interior wall of the associated tube, with each of the plurality of tubes further including a notch facing the engaging portion, with the pivotal portion of each of the plurality of blocking members located above the notch of the associated tube, with the lower arm of each of the plurality of blocking members abutting against the guiding wall of the mounting seat through the notch, with the lower arm of each of the plurality of blocking members abutting against the recessed segment of the guiding wall so that the balls held by the blocking members fall down from the discharge hole when the lower arm of the blocking member moves to the opening of the arcuate segment of the guiding wall.

3. The ball feeding device according to claim 2, with the upper arm of each of the plurality of blocking members being intermediate the lower arm of the blocking member and the upper end of the associated tube, and with the lower arm of each of the plurality of blocking members including an inner side abutting against the guiding wall of the mounting seat through the notch of the associated tube.

4. The ball feeding device according to claim 3, with the lower and upper arms of each of the plurality of blocking members formed into a claw-shaped in cross section for holding the ball in the associated tube, and with the guiding segment of the guiding wall being at obtuse angle with the recessed segment of the guiding wall.

5. The ball feeding device according to claim 4, comprising, in combination: a plurality of sleeves each engaged on the upper end of each of the plurality of tubes for containing a supply of balls.

* * * * *